US011508290B2

(12) United States Patent
Baek et al.

(10) Patent No.: US 11,508,290 B2
(45) Date of Patent: Nov. 22, 2022

(54) PIXEL, DISPLAY DEVICE, AND METHOD OF DRIVING DISPLAY DEVICE

(71) Applicant: SAMSUNG DISPLAY CO., LTD., Yongin-si (KR)

(72) Inventors: Yun Ki Baek, Yongin-si (KR); Oh Jo Kwon, Yongin-si (KR); Bong Hyun You, Yongin-si (KR); Seok Ha Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/328,969

(22) Filed: May 24, 2021

(65) Prior Publication Data

US 2022/0059016 A1 Feb. 24, 2022

(30) Foreign Application Priority Data

Aug. 24, 2020 (KR) ..... 10-2020-0106397

(51) Int. Cl.
*G09G 3/32* (2016.01)

(52) U.S. Cl.
CPC ..... *G09G 3/32* (2013.01); *G09G 2300/0819* (2013.01); *G09G 2310/066* (2013.01); *G09G 2320/0257* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 9,818,344 | B2 | 11/2017 | Lin et al. | |
| 10,748,482 | B2 | 8/2020 | Park et al. | |
| 2010/0156762 | A1* | 6/2010 | Choi | G09G 3/3233 345/76 |
| 2014/0333512 | A1* | 11/2014 | In | G09G 3/3233 345/76 |
| 2017/0116922 | A1* | 4/2017 | Jung | G09G 3/3258 |
| 2017/0365214 | A1* | 12/2017 | Tsai | G09G 3/3233 |
| 2018/0166021 | A1* | 6/2018 | Xi | G09G 3/3233 |
| 2018/0315374 | A1* | 11/2018 | Zhang | G09G 3/3233 |
| 2019/0266928 | A1 | 8/2019 | Kim et al. | |

FOREIGN PATENT DOCUMENTS

| | | | |
|---|---|---|---|
| JP | 2006-215275 | A | 8/2006 |
| KR | 10-2019-0090412 | A | 8/2019 |
| KR | 10-2019-0103540 | A | 9/2019 |
| KR | 10-2020-0059377 | A | 5/2020 |

* cited by examiner

*Primary Examiner* — Chad M Dicke
(74) *Attorney, Agent, or Firm* — Lewis Roca Rothgerber Christie LLP

(57) ABSTRACT

A pixel according to some embodiments includes a light source unit, a first transistor coupled between a first power source and a first node, and configured to control a driving current applied to the light source unit, a first bias transistor coupled between a first bias power source and a gate electrode of the first transistor, and a second bias transistor coupled between a second bias power source and a second node that is electrically coupled to an anode of the light source unit, wherein the first bias transistor and the second bias transistor are configured to be turned on during a first period before a data voltage is applied among one frame, and wherein the second bias transistor is configured to be turned on at least once during a second period after the data voltage is applied among the one frame.

20 Claims, 8 Drawing Sheets

PIXEL, DISPLAY DEVICE, AND METHOD OF DRIVING DISPLAY DEVICE

CROSS-REFERENCE TO RELATED APPLICATION

The application claims priority to, and the benefit of, Korean Patent Application No. 10-2020-0106397, filed Aug. 24, 2020, which is hereby incorporated by reference for all purposes as if fully set forth herein.

BACKGROUND

1. Field

The present disclosure relates to a pixel, a display device, and a method of driving the display device.

2. Description of the Related Art

As interest in information display increases, and as the demand to use a portable information medium increases, the demand for, and commercialization of, a display device are intensively made.

SUMMARY

A technical problem solved herein provides a display device capable of improving an afterimage.

A pixel according to some embodiments of the present disclosure may include a light source unit, a first transistor coupled between a first power source and a first node, and configured to control a driving current applied to the light source unit, a first bias transistor coupled between a first bias power source and a gate electrode of the first transistor, and a second bias transistor coupled between a second bias power source and a second node that is electrically coupled to an anode of the light source unit, wherein the first bias transistor and the second bias transistor are configured to be turned on during a first period before a data voltage is applied among one frame, and wherein the second bias transistor is configured to be turned on at least once during a second period after the data voltage is applied among the one frame.

A voltage of the first bias power source may have a level that is lower than that of the second bias power source.

The pixel may further include a third bias transistor coupled between the first node and the second node.

The third bias transistor may be configured to be turned off in the second period among the one frame.

The pixel may further include a second transistor coupled between the gate electrode of the first transistor and a data line for applying the data voltage, and a third transistor coupled between the first node and a sensing line for receiving a voltage of an initialization power source.

The second transistor and the third transistor may be configured to be simultaneously turned on between the first period and the second period.

The pixel may further include a storage capacitor coupled between the first node and the gate electrode of the first transistor, and configured to store the data voltage.

The light source unit may include at least one light emitting element configured to emit light by the driving current.

The first transistor may be configured to receive the driving current from the first power source, wherein the light source unit is configured to supply the driving current supplied from the first transistor to a second power source that is set to a voltage value that is lower than that of the first power source.

The first bias power source may be the second power source, wherein the second bias power source is the initialization power source.

A display device according to some embodiments of the present disclosure may include a plurality of pixels; and a power source driver providing a first bias power source and a second bias power source to the plurality of pixels, wherein each of the plurality of pixels including a light source unit, a first transistor coupled between a first power source and a first node for controlling a driving current applied to the light source unit, a first bias transistor coupled between a first bias power source and a gate electrode of the first transistor, and a second bias transistor coupled between a second bias power source and a second node that is electrically coupled to an anode of the light source unit, and a power source driver for providing the first bias power source and the second bias power source to the pixels, wherein the first bias transistor and the second bias transistor are configured to be turned on during a first period before a data voltage is applied among one frame, and wherein the second bias transistor is configured to be turned on at least once during a second period after the data voltage is applied among the one frame.

A voltage of the first bias power source may have a level that is lower than that of the second bias power source.

The pixels may further include a third bias transistor coupled between the first node and the second node, and configured to be turned off in the second period among the one frame.

The each of the plurality of pixels may further include a second transistor coupled between the gate electrode of the first transistor and a data line for applying the data voltage, and a third transistor coupled between the first node and a sensing line for receiving a voltage of an initialization power source.

The second transistor and the third transistor may be configured to be simultaneously turned on between the first period and the second period.

The first transistor may be configured to receive the driving current from the first power source, wherein the light source unit is configured to supply the driving current supplied from the first transistor as a second power source that is set to a voltage value that is lower than that of the first power source.

The first bias power source may be the second power source, wherein the second bias power source is the initialization power source.

A method of driving a display device according to some embodiments of the present disclosure may include supplying a first bias voltage to a gate electrode of a first transistor, and supplying a second bias voltage to an anode of a light source unit, during a first period of one frame, supplying a data voltage to a storage capacitor coupled to the gate electrode of the first transistor after the first period, and supplying the second bias voltage to the anode of the light source unit during a second period among the one frame after the data voltage is supplied.

The first bias voltage may have a level that is lower than the second bias voltage.

The second period may occur multiple times during the one frame.

BRIEF DESCRIPTION OF THE DRAWINGS

The accompanying drawings, which are included to provide a further understanding of the claimed embodiments, are incorporated in and constitute a part of this specification, and serve to explain aspects of the claimed embodiments together with the description.

DETAILED DESCRIPTION

Figure 1:
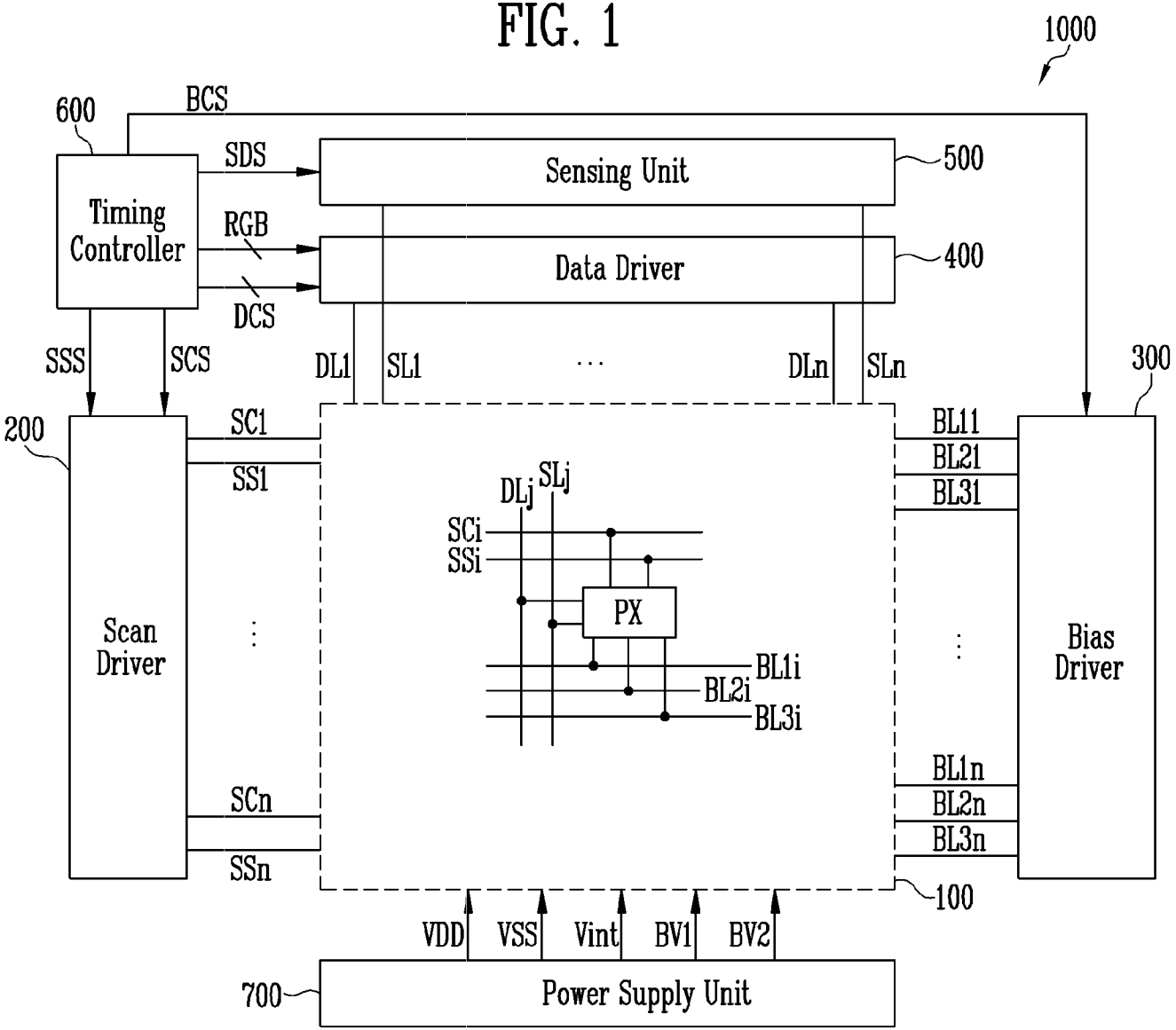
FIG. 1 is a schematic block diagram illustrating a display device according to some embodiments.

Aspects of some embodiments of the present disclosure and methods of accomplishing the same may be understood more readily by reference to the detailed description of embodiments and the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects of the present disclosure to those skilled in the art. Accordingly, processes, elements, and techniques that are not necessary to those having ordinary skill in the art for a complete understanding of the aspects of the present disclosure may not be described.

Unless otherwise noted, like reference numerals, characters, or combinations thereof denote like elements throughout the attached drawings and the written description, and thus, descriptions thereof will not be repeated. Further, parts not related to the description of the embodiments might not be shown to make the description clear.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "formed on," "on," "connected to," or "coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z," "at least one of X, Y, or Z," and "at least one selected from the group consisting of X, Y, and Z" may be construed as X only, Y only, Z only, any combination of two or more of X, Y, and Z, such as, for instance, XYZ, XYY, YZ, and ZZ, or any variation thereof. Similarly, the expression such as "at least one of A and B" may include A, B, or A and B. As used herein, the term "and/or" includes any and all combinations of one or more of the associated listed items. For example, the expression such as "A and/or B" may include A, B, or A and B.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a display device according to embodiments of the present disclosure will be described with reference to the drawings related to the embodiments of the present disclosure.

FIG. 1 is a schematic block diagram illustrating a display device according to some embodiments.

Referring to FIG. 1, a display device 1000 according to some embodiments may include a display unit 100, a scan driver 200, a bias driver 300, a data driver 400, a sensing unit 500, a timing controller 600, and a power supply unit 700.

The display unit 100 may include a plurality of pixels PX and may display an image. The display unit 100 may include a plurality of data lines DL1, . . . , and DLn, a plurality of sensing lines SL1, . . . , and SLn, a plurality of scan lines SC1, . . . , and SCn, a plurality of sensing control lines SS1, . . . , and SSn, a plurality of bias control lines BL11, . . . , BL1*n*, BL21, . . . , BL2*n*, BL31, . . . , and BL3*n*, and a plurality of pixels PX positioned to be respectively connected to the plurality of data lines DL1, . . . , and DLn and the plurality of scan lines SC1, . . . , and SCn. Each pixel PX may receive voltages of a first power source VDD, a second power source VSS, an initialization power source Vint, a first bias power source BV1, and a second bias power source BV2 from the power supply unit 700.

Here, the first power source VDD, the second power source VSS, the first bias power source BV1, and the second bias power source BV2 may be supplied to the pixel PX through separate power source lines, and the initialization power source Vint may be supplied to the pixel PX through the sensing lines SL. However, the present disclosure is not limited thereto.

The scan driver 200 may receive a scan control signal SCS from the timing controller 600. The scan driver 200 may sequentially supply scan signals to the scan lines SC in response to the scan control signal SCS. Also, the scan driver 200 may receive a sensing line control signal SSS from the timing controller 600. The scan driver 200 may sequentially supply sensing control signals to the sensing control lines SS in response to the sensing line control signal SSS.

As some embodiments, in FIG. 1, the scan driver 200 may be connected to the plurality of scan lines SC1, . . . , and SCn and to the plurality of sensing control lines SS1, . . . , and SSn to supply the scan signals and the sensing control signals, but the present disclosure is not limited thereto. According to some embodiments, the plurality of sensing control lines SS1, . . . , and SSn may be connected to a separate driver, and the separate driver may supply the sensing control signals to the sensing control lines SS.

The bias driver 300 may receive a bias driving control signal BCS from the timing controller 600. The bias driver 300 may sequentially supply bias control signals to the plurality of bias control lines BL11, . . . , BL1*n*, BL21, . . . , BL2*n*, BL31, . . . , and BL3*n* in response to the bias driving control signal BCS. In some embodiments, the plurality of bias control lines BL11, . . . , BL1*n*, BL21, . . . , BL2*n*, BL31, . . . , and BL3*n* may include a first bias control line BL1, a second bias control line BL2, and a third bias control line BL3. Accordingly, the bias driver 300 may supply a first bias control signal to the first bias control line BL1, may supply a second bias control signal to the second bias control line BL2, and may supply a third bias control signal to the third bias control line BL3.

In FIG. 1, the bias control lines BL1, BL2, and BL3 are shown to be connected to one bias driver 300, but the present disclosure is not limited thereto. According to some embodiments, each of the bias control lines BL1, BL2, and BL3 may be connected to different bias drivers.

The data driver 400 may receive a data control signal DCS from the timing controller 600. The data driver 400 may convert image data RGB into analog data signals (or data voltages) in response to the data control signal DCS, and sequentially supply the data signals to the data lines DL.

The sensing unit 500 may receive a sensing driving control signal SDS from the timing controller 600. The sensing unit 500 may supply the initialization power source Vint to the sensing lines SL in response to the sensing driving control signal SDS. Also, the sensing unit 500 may receive a sensing signal corresponding to deterioration information of the pixels PX from the pixels PX. As shown in FIG. 1, the sensing unit 500 is shown as a separate configuration from the data driver 400, but the present disclosure is not limited thereto. According to some embodiments, the sensing unit 500 may be included in the data driver 400.

The timing controller 600 may receive an input control signal and an input image signal from an image source such as an external graphic device. The timing controller 600 may generate the image data RGB that is suitable for the operating conditions of the display unit 100 based on the input image signal, and may provide the image data RGB to the data driver 400. The timing controller 600 may generate the scan control signal SCS for controlling the driving timing of the scan driver 200, may generate the sensing line control signal SSS based on the input control signal, and may provide the scan control signal SCS and the sensing line control signal SSS to the scan driver 200. Also, the timing controller 600 may generate the bias driving control signal BCS for controlling the driving timing of the bias driver 300, the data control signal DCS for controlling the driving timing of the data driver 400, and the sensing driving control signal SDS for controlling the driving timing of the sensing unit 500 based on the input control signal, and may provide the bias driving control signal BCS, the data control signal DCS, and the sensing driving control signal SDS to the bias driver 300, the data driver 400, and the sensing unit 500, respectively.

The power supply unit 700 may supply the voltages of the first power source VDD, the second power source VSS, the initialization power source Vint, the first bias power source BV1, and the second bias power source BV2 to the pixel PX. The first power source VDD may be a voltage having a high level that is provided to an anode of a light emitting element LD (shown in FIG. 2) included in the pixel PX, and the second power source VSS may be a voltage having a low level that is provided to a cathode of the light emitting element LD (shown in FIG. 2) included in the pixel PX. The first power source VDD and the second power source VSS may be driving voltage sources for emitting light from the pixel PX. The initialization power source Vint may be a power source for initializing (or resetting) the pixel PX, and may be a voltage having a level that is different from that of the second power source VSS. The first bias power source BV1 may be a voltage source provided to a first transistor T1 (shown in FIG. 2) of the pixel PX, and the second bias power source BV2 may be a voltage source provided to the anode of the light emitting element LD. In some embodiments, a voltage provided by the first bias power source BV1 may be lower than a voltage provided by the second bias power source BV2.

In FIG. 1, the timing controller 600, the sensing unit 500, the data driver 400, and the power supply unit 700 are shown as separate configurations, but the present disclosure is not limited thereto. At least two of the timing controller 600, the sensing unit 500, the data driver 400, and the power supply unit 700 may be implemented in the form of a single chip.

Hereinafter, a pixel according to some embodiments will be described with reference to FIG. 2.

Figure 2:
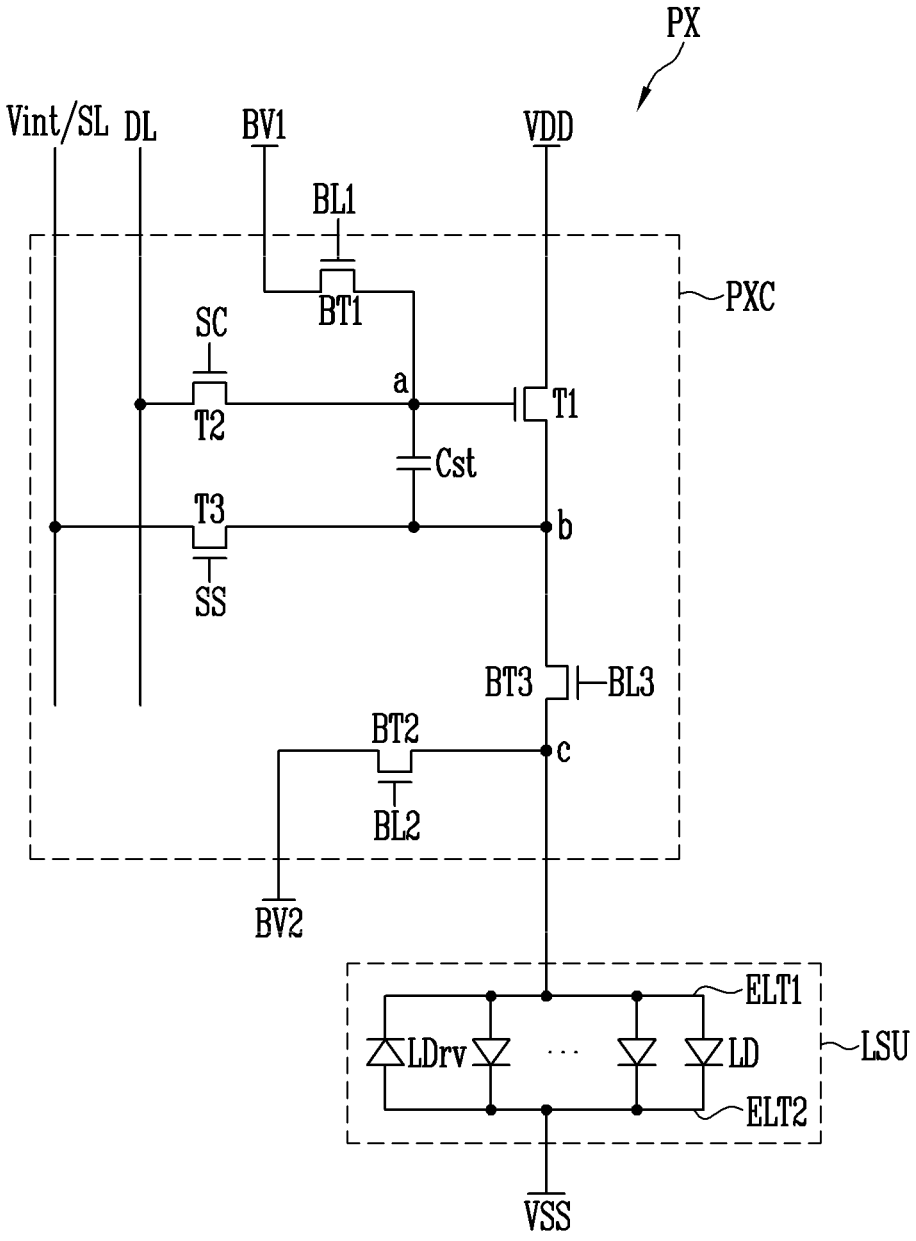
FIG. 2 is a circuit diagram illustrating one pixel of the display device according to some embodiments.

FIG. 2 is a circuit diagram illustrating one pixel of the display device according to some embodiments.

Referring to FIG. 2, one pixel PX according to some embodiments may include a pixel circuit PXC and a light source unit LSU for generating light having a luminance corresponding to a data signal.

The pixel circuit PXC may include a first transistor T1, a second transistor T2, a third transistor T3, a storage capacitor Cst, and bias transistors BT1, BT2, and BT3. The bias transistors BT1, BT2, and BT3 may include a first bias transistor BT1, a second bias transistor BT2, and a third bias transistor BT3.

The first transistor T1 may be a driving transistor for controlling a driving current applied to the light source unit LSU, and may be connected between the first power source VDD and the first node b. For example, a first electrode of the first transistor T1 may be connected to the first power source VDD, a second electrode of the first transistor T1 may be connected to the first node b, and a gate electrode of the first transistor T1 may be connected to a third node a. The first transistor T1 may control the driving current applied from the first power source VDD to the light source unit LSU through the first node b according to a voltage difference between the first node b and the third node a. In some embodiments, the first electrode of the first transistor T1 may be a drain electrode, and the second electrode of the first transistor T1 may be a source electrode, but the present disclosure is not limited thereto. According to some embodiments, the first electrode may be the drain electrode, and the second electrode may be the source electrode.

The second transistor T2 may be a switching transistor that selects the pixel PX and activates the pixel PX in response to a scan signal, and may be connected between a data line DL and the third node a. For example, a first electrode of the second transistor T2 may be connected to the data line DL, a second electrode of the second transistor T2 may be connected to the third node a, and a gate electrode of the second transistor T2 may be connected to a scan line SC. The second transistor T2 may be turned on when the scan signal having a gate-on voltage (for example, a high level voltage) is supplied from the scan line SC to electrically connect the data line DL and the third node a. Here, the third node a may be a point where the second electrode of the second transistor T2 and the gate electrode of the first transistor T1 are connected, and the second transistor T2 may transfer a data voltage to the gate electrode of the first transistor T1.

The third transistor T3 may be a sensing transistor for externally compensating for the pixel PX, and may be connected between a sensing line SL and the first node b. For example, a first electrode of the third transistor T3 may be connected to the sensing line SL, a second electrode of the third transistor T3 may be connected to the first node b, and a gate electrode of the third transistor T3 may be connected to a sensing control line SS. The third transistor T3 may be turned on when a sensing control signal having the gate-on voltage (for example, the high level voltage) is supplied from the sensing control line SS to electrically connect the sensing line SL and the first node b.

According to some embodiments, the display device may be driven by dividing the operation thereof into a display period and a sensing period.

The sensing period may be a period for extracting characteristics of each of the pixels PX (e.g., a threshold voltage of the first transistor T1).

During the sensing period, the third transistor T3 may obtain the sensing signal through the sensing line SL by connecting the first transistor T1 to the sensing line SL, and may detect the characteristics of each pixel PX, including the threshold voltage of the first transistor T1, using the sensing signal. Information on the characteristics of each pixel PX may be used to convert the image data so that a characteristic deviation between the pixels PX may be compensated.

In addition, the third transistor T3 may be an initialization transistor capable of initializing the first node b. When the third transistor T3 is turned on by the sensing control signal during the sensing period and/or the display period, a voltage of the initialization power source Vint may be transferred to the first node b. Accordingly, the other electrode of the storage capacitor Cst that is connected to the first node b may be initialized.

According to some embodiments, the sensing line SL may be omitted, and the first electrode of the third transistor T3 may be connected to the data line DL. In addition, when the sensing control line SS is omitted, the gate electrode of the third transistor T3 may be connected to the scan line SC.

Meanwhile, various methods for extracting information on the characteristics of the pixel PX during the sensing period may be used. In some embodiments, the pixels PX may be driven by various driving methods during the sensing period.

In addition, the display period may be a period in which an image (e.g., a predetermined image) is displayed by the pixels PX in response to the data signal. A process of driving the pixels PX during the display period will be described below with reference to FIG. 3.

One electrode of the storage capacitor Cst may be connected to the third node a, and the other electrode of the storage capacitor Cst may be connected to the first node b. The storage capacitor Cst may be charged with the data voltage corresponding to the data signal supplied to the third node a during each frame period. Accordingly, the storage capacitor Cst may store a voltage (that is, the data voltage) of the gate electrode of the first transistor T1.

The first bias transistor BT1 may be a transistor for applying a bias voltage to the first transistor T1, and may be connected between the first bias power source BV1 and the third node a. For example, a first electrode of the first bias transistor BT1 may be connected to the first bias power source BV1, a second electrode of the first bias transistor BT1 may be connected to the third node a, and a gate electrode of the first bias transistor BT1 may be connected to the first bias control line BL1. The first bias transistor BT1 may be turned on when the first bias control signal having the gate-on voltage (for example, the high level voltage) is supplied from the first bias control line BL1 to connect the first bias power source BV1 and the third node a. Accordingly, a voltage of the first bias power source BV1 may be applied to the gate electrode of the first transistor T1. Here, the voltage applied from the first bias power source BV1 may be referred to as a first bias voltage.

The second bias transistor BT2 may be a transistor for applying a bias voltage to the light source unit LSU, and may be connected between the second bias power source BV2 and a second node c. For example, a first electrode of the second bias transistor BT2 may be connected to the second bias power source BV2, a second electrode of the second bias transistor BT2 may be connected to the second node c, and a gate electrode of the second bias transistor BT2 may be connected to the second bias control line BL2. The second bias transistor BT2 may be turned on when the second bias control signal having the gate-on voltage (for example, the high level voltage) is supplied from the second bias control line BL2 to connect the second bias power source BV2 and the second node c. Accordingly, a voltage of the second bias power source BV2 may be applied to the second node c. The second node c may be a point where the light source unit LSU and the pixel circuit PXC are connected, and the voltage of the second bias power source BV2 may be supplied to one electrode of the light source unit LSU. Here, the voltage applied from the second bias power source BV2 may be referred to as a second bias voltage.

The third bias transistor BT3 may be a transistor for adjusting a bias application timing (or emission timing), and may be connected between the first node b and the second node c. For example, a first electrode of the third bias transistor BT3 may be connected to the first node b, a second electrode of the third bias transistor BT3 may be connected to the second node c, and a gate electrode of the third bias transistor BT3 may be connected to the third bias control line BL3. The third bias transistor BT3 may be turned on when the third bias control signal having the gate-on voltage (for example, the high level voltage) is supplied from the third bias control line BL3 to connect the first node b and the second node c. That is, the third bias transistor BT3 may electrically connect the first transistor T1 and the light source unit LSU. Accordingly, a voltage of the first node b may be applied to the second node c.

In some embodiments, each of the first transistor T1, the second transistor T2, the third transistor T3, and the bias transistors BT1, BT2, and BT3 may include a silicon semiconductor and may be an N-type transistor. However, the present disclosure is not limited thereto. According to some embodiments, at least one of the first transistor T1, the second transistor T2, the third transistor T3, and the bias transistors BT1, BT2, and BT3 may include an oxide semiconductor, or may be changed to a P-type transistor.

The light source unit LSU may include at least one light emitting element LD connected between the first power source VDD and the second power source VSS.

In some embodiments, light emitting elements LD may be micro light emitting elements having a size as small as nano-scale to micro-scale. These micro light emitting elements may include a material having an inorganic crystal structure, and the material having the inorganic crystal structure may emit light. However, this is an example, and at least one of the light emitting elements LD may be an organic light emitting element.

The light source unit LSU may include a first electrode ELT1 (also referred to as a first pixel electrode or first alignment electrode) connected to the first power source VDD through the pixel circuit PXC, a second electrode ELT2 (also referred to as a second pixel electrode or second alignment electrode) connected to the second power source VSS, and a plurality of light emitting elements LD connected in parallel in the same direction between the first electrode ELT1 and the second electrode ELT2. In some embodiments, the first electrode ELT1 may be the anode, and the second electrode ELT2 may be the cathode.

According to some embodiments, the first power source VDD and the second power source VSS may have different potentials so that the light emitting elements LD emit light. As an example, the first power source VDD may be set as a high potential power source, and the second power source VSS may be set as a low potential power source. In this case, a potential difference between the first power source VDD and the second power source VSS may be set to be greater than or equal to threshold voltages of the light emitting elements LD during an emission period of the pixel PX.

Each of the light emitting elements LD may emit light with a luminance corresponding to the driving current supplied through a corresponding pixel circuit PXC. For example, during each frame period, the pixel circuit PXC may supply the driving current corresponding to a grayscale value to be expressed in a corresponding frame to the light source unit LSU. The driving current supplied to the light source unit LSU may be divided, and may flow to the light emitting elements LD connected in a forward direction. Accordingly, while each light emitting element LD emits light with a luminance corresponding to a current flowing therethrough, the light source unit LSU may emit light with the luminance corresponding to the driving current.

The light emitting elements LD may be connected in parallel in the forward direction between the first electrode ELT1 and the second electrode ELT2. Each light emitting element LD connected in the forward direction between the first power source VDD and the second power source VSS may constitute an effective light source, and these effective light sources may constitute the light source unit LSU of the pixel.

In some embodiments, the light source unit LSU may further include at least one non-effective light source in addition to the light emitting elements LD constituting each effective light source. For example, at least one reverse light emitting element LDrv may be also connected between the first electrode ELT1 and the second electrode ELT2.

Each reverse light emitting element LDrv may be connected in parallel between the first electrode ELT1 and the second electrode ELT2 together with the light emitting elements LD constituting effective light sources, and may be connected between the first electrode ELT1 and the second electrode ELT2 in a direction that is opposite to the light emitting elements LD. The reverse light emitting element LDrv may maintain a deactivated state even when a driving voltage (e.g., a predetermined driving voltage, and/or a forward driving voltage) is applied between the first electrode ELT1 and the second electrode ELT2. Accordingly, the reverse light emitting element LDrv may substantially maintain a non-emission state.

According to some embodiments, the light source unit LSU may include at least two light emitting elements LD connected in series with each other. In some embodiments, the light source unit LSU may include a plurality of light emitting elements LD connected in series in the forward direction between the first power source VDD and the second power source VSS, and the plurality of light emitting elements LD may constitute each effective light source.

Hereinafter, an operation of the pixel according to some embodiments will be described with reference to FIG. 3.

Figure 3:
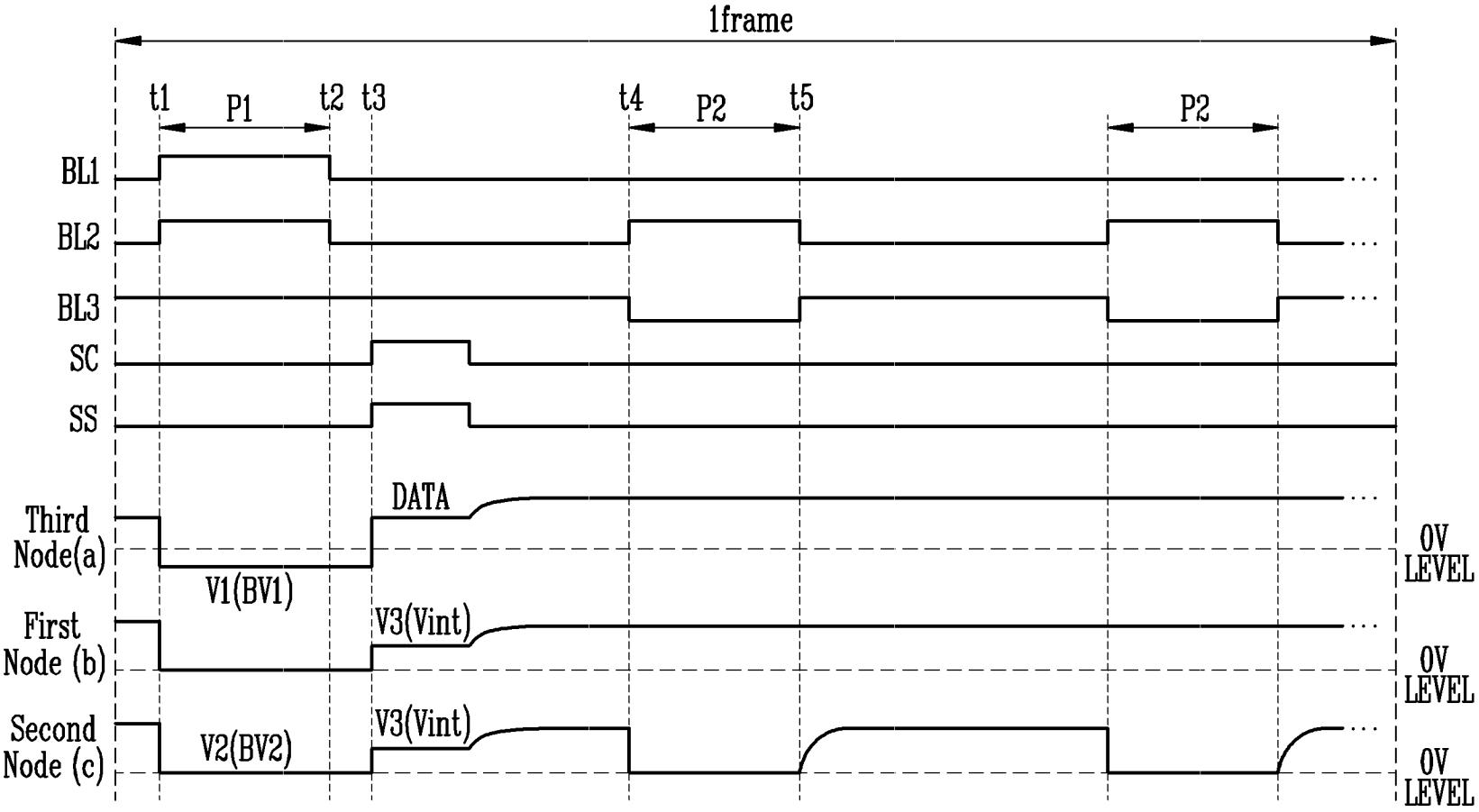
FIG. 3 is a timing diagram illustrating an example of an operation of one pixel shown in FIG. 2.

FIG. 3 is a timing diagram illustrating an example of an operation of one pixel shown in FIG. 2. FIG. 3 shows one frame of the display time.

Referring to FIG. 3, first, the first bias control signal and the second bias control signal may be supplied to the first bias control line BL1 and the second bias control line BL2, respectively, so that the first bias transistor BT1 and the second bias transistor BT2 may be turned on.

That is, the first bias transistor BT1 and the second bias transistor BT2 may be turned on between a first time point t1 and a second time point t2. A period between the first time point t1 and the second time point t2 may be referred to as a first period P1 among one frame. Before and after the first period P1, because the third bias transistor BT3 is supplied with the third bias control signal, the third bias transistor BT3 may be continuously turned on.

In the first period P1, as the first bias transistor BT1 is turned on, the voltage of the first bias power source BV1 may be applied to the third node a. That is, a first bias voltage level V1 may be applied to the gate electrode of the first transistor T1. In some embodiments, the first bias voltage level V1 may be set to various voltages so that the third node a may be initialized. For example, the first bias voltage level V1 may be set to about −1V, but the present disclosure is not limited thereto.

In addition, in the first period P1, as the second bias transistor BT2 is turned on, the voltage of the second bias power source BV2 may be applied to the second node c. Also, because the third transistor T3 is turned on, the second bias voltage may be applied to the first node b as well. According to some embodiments, a second bias voltage level V2 may be higher than the first bias voltage level V1, and may have various values. For example, the second bias voltage level V2 may be set to about OV, but the present disclosure is not limited thereto.

The first period P1 may be a period in which the bias voltage is (e.g., respective bias voltages are) applied to each node connected to the first transistor T1 and the light source unit LSU.

After the second time point t2, the first bias transistor BT1 and the second bias transistor BT2 may be turned off, but the first bias voltage level V1 applied to the third node a and the second bias voltage level V2 applied to the first node b and the second node c may be maintained.

At a third time point t3, the scan signal and the sensing control signal may be supplied to the scan line SC and the sensing control line SS, respectively, so that the second transistor T2 and the third transistor T3 may be turned on.

As the second transistor T2 is turned on, a data voltage DATA may be applied to the third node a. That is, the data voltage DATA may be applied to the gate electrode of the first transistor T1, and the data voltage DATA may be stored in the gate electrode via one electrode of the storage capacitor Cst connected to the gate electrode of the first transistor T1. That is, the data voltage DATA may be applied after the first period P1 in which the voltage of the first bias power source BV1 is applied to the first transistor T1, and in which the voltage of the second bias power source BV2 is applied to the light source unit LSU.

As the third transistor T3 is turned on, a voltage level V3 of the initialization power source Vint may be applied to the first node b. Because the third bias transistor BT3 is turned on even after the third time point t3, the initialization voltage level V3 that is applied to the first node b may be also applied to the second node c. Because the first node b is connected to the other electrode of the storage capacitor Cst, the initialization voltage level V3 may be stored in the first node b. Additionally, the initialization voltage level V3 of the initialization power source Vint may be set to be about equal to, or higher than, the second bias voltage level V2 of the second bias power source BV2.

After the third time point t3, a voltage corresponding to the difference between the data voltage DATA and the initialization voltage level V3 may be stored in the storage capacitor Cst. Here, because the initialization voltage level V3 is fixed to a constant voltage, the voltage stored in the storage capacitor Cst may be determined by the data voltage DATA.

After the voltage corresponding to the difference between the data voltage DATA and the initialization voltage level V3 is stored in the storage capacitor Cst, the first transistor T1 may supply a current corresponding to the voltage stored in the storage capacitor Cst to the light source unit LSU through the first node b, through the third bias transistor BT3, and through the second node c. Then, the light source unit LSU may generate light (e.g., light having a predetermined luminance) in response to the amount of current supplied from the first transistor T1.

Between a fourth time point t4 and a fifth time point t5, the second bias control signal may be supplied to the second bias control line BL2, and the third bias control signal may be not supplied to the third bias control line BL3.

When the second bias control signal is supplied to the second bias control line BL2, the second bias transistor BT2 may be turned on. When the supply of the third bias control signal to the third bias control line BL3 is stopped, the third bias transistor BT3 may be turned off. Accordingly, the first node b and the second node c may be electrically separated.

When the second bias transistor BT2 is turned on, the second bias voltage level V2 may be applied to the second node c. When the second bias voltage level V2 is applied to the second node c, the light emitting elements LD included in the light source unit LSU may be initialized to the applied bias state. In this case, the light emitting elements LD may be in the non-emission state.

A period between the fourth time point t4 and the fifth time point t5 may be referred to as a second period P2 among one frame. That is, the second period P2 may be a period in which the second bias power source BV2 is supplied only to the light source unit LSU after the data voltage DATA is applied to the pixel PX.

After the fifth time point t5, as the third bias transistor BT3 is turned on again, the second node c may be connected to the first node b, and a voltage of the second node c may be transferred to the first node b. In this case, the light source unit LSU may generate light (e.g., light having a predetermined luminance) in response to the amount of current supplied from the first transistor T1.

Meanwhile, although the second period P2 is included once during one frame in FIG. 3, the present disclosure is not limited thereto. For example, the second period P2 for supplying the second bias voltage level V2 to the light source unit LSU may be included more than once in one frame.

In the second period P2, because the third bias transistor T3 is turned off, the bias voltage for supplementing the characteristics of the light source unit LSU may be provided regardless of the driving of the first transistor T1 and the data voltage DATA stored in the storage capacitor Cst.

Because the third bias transistor T3 connected to the second node c is turned off during the second period P2, the light emitting element LD of the light source unit LSU might not be supplied with the driving current, and might not emit light. That is, the second period P2 may be referred to as a non-emission period.

Accordingly, the display device according to some embodiments may apply the bias voltage to the driving transistor and/or the light emitting element during one frame. Therefore, when an afterimage occurs due to changes in characteristics of the driving transistor and/or the light emitting element, the recovery time of the afterimage may be reduced.

Hereinafter, characteristics of a display device according to a comparative example and characteristics of a display device according to some embodiments will be described with reference to FIGS. 4A, 4B and 5.

Figure 4A:
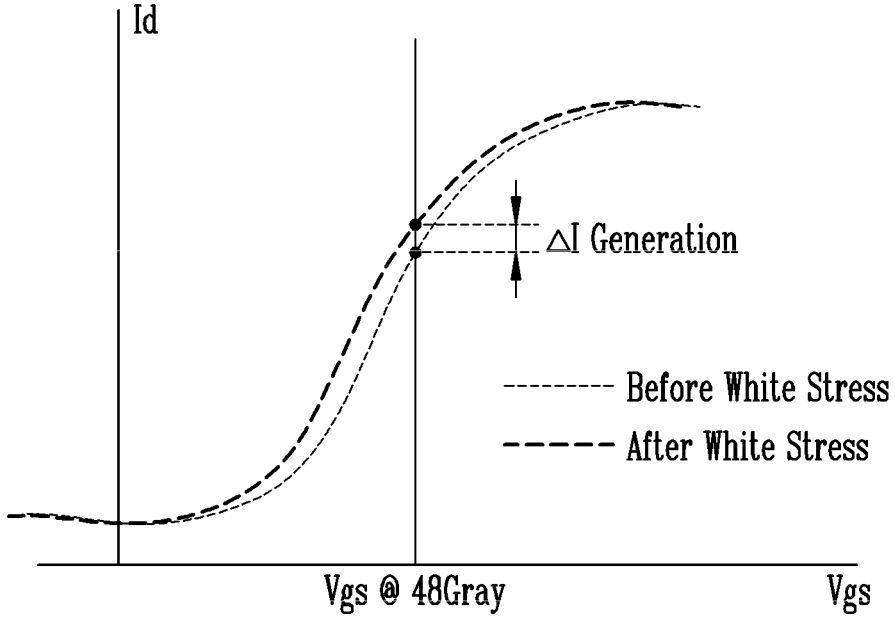
FIG. 4A is a graph for explaining a change in characteristics of a first transistor in which an afterimage may occur in a display device according to a comparative example.
Figure 4B:
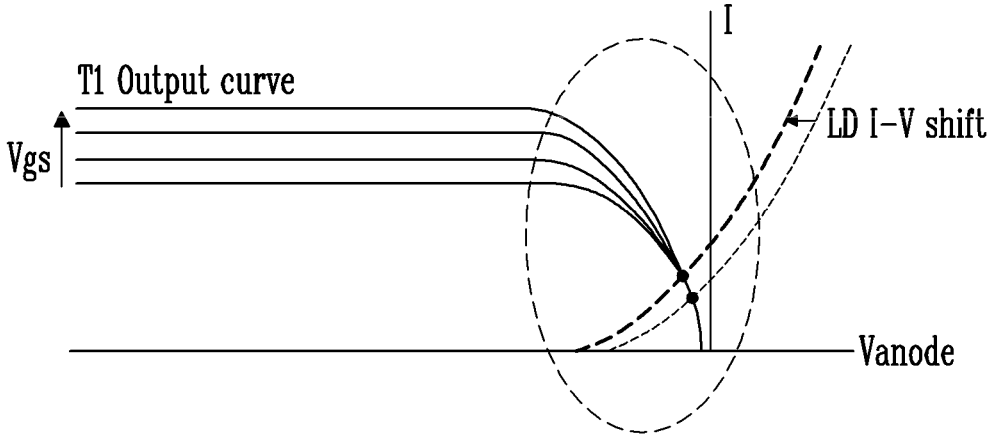
FIG. 4B is a graph for explaining a change in characteristics of a light emitting element in which an afterimage may occur in the display device according to a comparative example.
Figure 5:
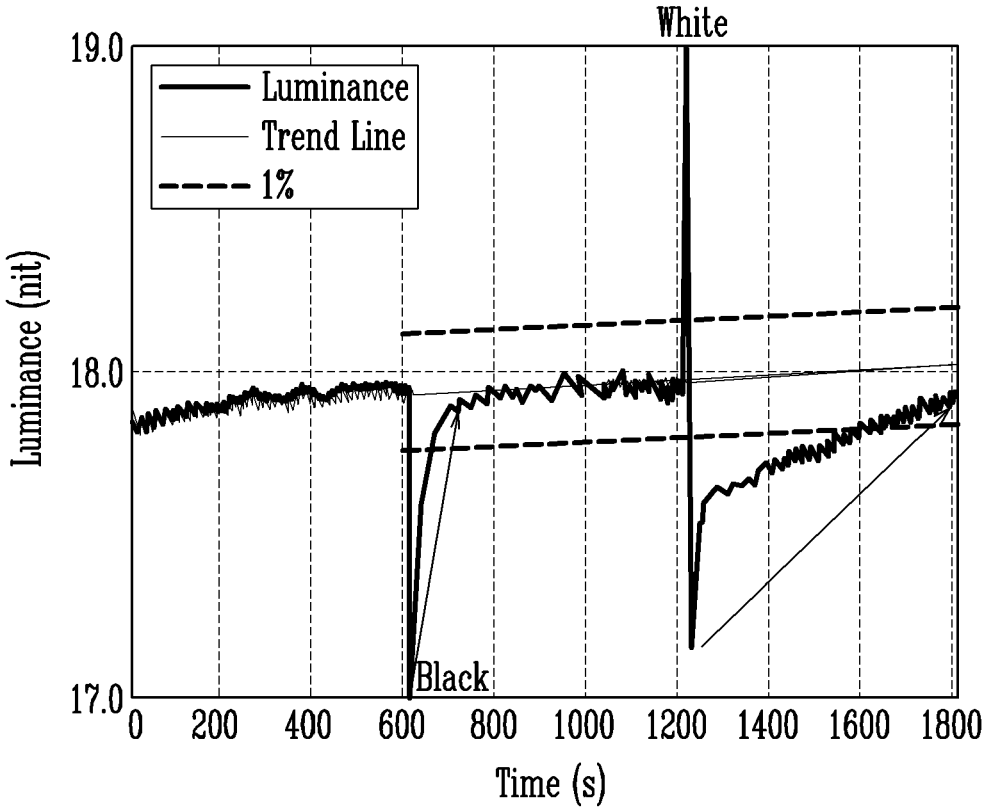
FIG. 5 is a graph for explaining an effect of improving an afterimage in the display device according to some embodiments.

FIG. 4A is a graph for explaining a change in characteristics of a first transistor in which an afterimage may occur in a display device according to a comparative example, FIG. 4B is a graph for explaining a change in characteristics of a light emitting element in which an afterimage may occur in the display device according to a comparative example, and FIG. 5 is a graph for explaining an effect of improving an afterimage in the display device according to some embodiments. Hereinafter, a description will be given with reference to the circuit diagram of FIG. 2 described above.

Referring to FIG. 4A, in a display device according to a comparative example, gate-source voltages Vgs of the first transistor T1 before and after applying white stress to the display device are shown.

The first transistor T1 may be connected between the first power source VDD and the light source unit LSU, and may provide the driving current to the light source unit LSU so that the light source unit LSU may emit light. A gate-source voltage Vgs of the first transistor T1 may be determined by the data voltage applied through the second transistor T2. In addition, the first transistor T1 may provide the driving current to the light source unit LSU according to the gate-source voltage Vgs of the first transistor T1.

However, when the threshold voltage or the like of the first transistor T1 is changed, even if the same data voltage is applied, the driving current provided to the light source unit LSU may gradually increase. When the driving current increases, because the luminance of light emitted from the light emitting element of the light source unit LSU increases, the afterimage may remain even if the image of one frame is changed.

As shown in FIG. 4A, a case where the data voltage corresponding to white is supplied during an example frame period will be described as an example. Here, when 48 grayscales are implemented before an example frame and 48 grayscales are implemented after the example frame, it can be seen that the driving current Id according to the same gate-source voltage Vgs is set differently. As described above, in the display device according to the comparative example, problems such as an increase in luminance of light emitted from the light emitting element and generation of the afterimage may occur due to the change in characteristics of the first transistor T1. In some embodiments, to solve this problem, the first bias voltage for controlling the gate-source voltage Vgs of the first transistor T1 may be applied.

When the first bias voltage is applied to the gate electrode of the first transistor T1, the first transistor T1 may be initialized to the characteristics corresponding to the first bias voltage regardless of the data voltage supplied in a previous frame period.

Referring to FIG. 4B, in the display device according to the comparative example, as the gate-source voltage Vgs of the first transistor T1 increases, the driving current I may increase. In addition, as the driving current applied to the anode of the light emitting element increases, the current flowing through the light emitting element may also increase. Accordingly, because the luminance of light emitted from the light emitting element increases, the afterimage may remain even if the image of one frame is changed. As described above, in the display device according to the comparative example, problems such as increase in luminance of light emitted from the light emitting element and generation of the afterimage may occur due to the change in characteristics of the light emitting element.

Therefore, to solve this problem, in some embodiments, the second bias voltage for controlling the voltage applied to the anode of the light emitting element may be applied.

Referring to FIG. 5, in a display device according to some embodiments, a change in luminance over time can be confirmed.

To check the degree of recovery of the afterimage of a display panel, in a display device emitting light (e.g., light with a predetermined luminance) according to some embodiments, stress was applied in black and/or white to darken or brighten the brightness of the display device. The line shown thicker than the trend line represents the luminance of the display device when black and/or white stress is applied.

At about 600 s, the black stress was applied to the display device. At about 1200 s, the black stress was again applied to the display device after the white stress. In this case, looking at a trend in which the display device recovers to display (e.g., to display a predetermined luminance), at about 600 s, it can be seen that the display device can quickly recover (e.g., recover to the predetermined luminance) after the black stress. The fact that it takes a short time to recover (e.g., recover to the predetermined luminance) after stress is applied may mean that an instantaneous afterimage can be quickly improved.

Therefore, in some embodiments, by applying the first bias voltage and the second bias voltage for applying the black stress to the display device, even if the characteristics of the first transistor and the light emitting element change, the afterimage can be quickly recovered. In some embodiments, to apply the black stress, the first bias voltage and the second bias voltage having a low level may be applied.

That is, in the display device according to some embodiments, the bias voltage having the low level may be applied to the driving transistor and/or the light emitting element LD during one frame. Therefore, when the afterimage occurs due to the changes in characteristics of the driving transistor and/or the light emitting element LD, the recovery time of the afterimage may be reduced.

Hereinafter, a display device and a method of driving the same according to some embodiments will be described with reference to FIGS. 6 to 8.

Figure 6:
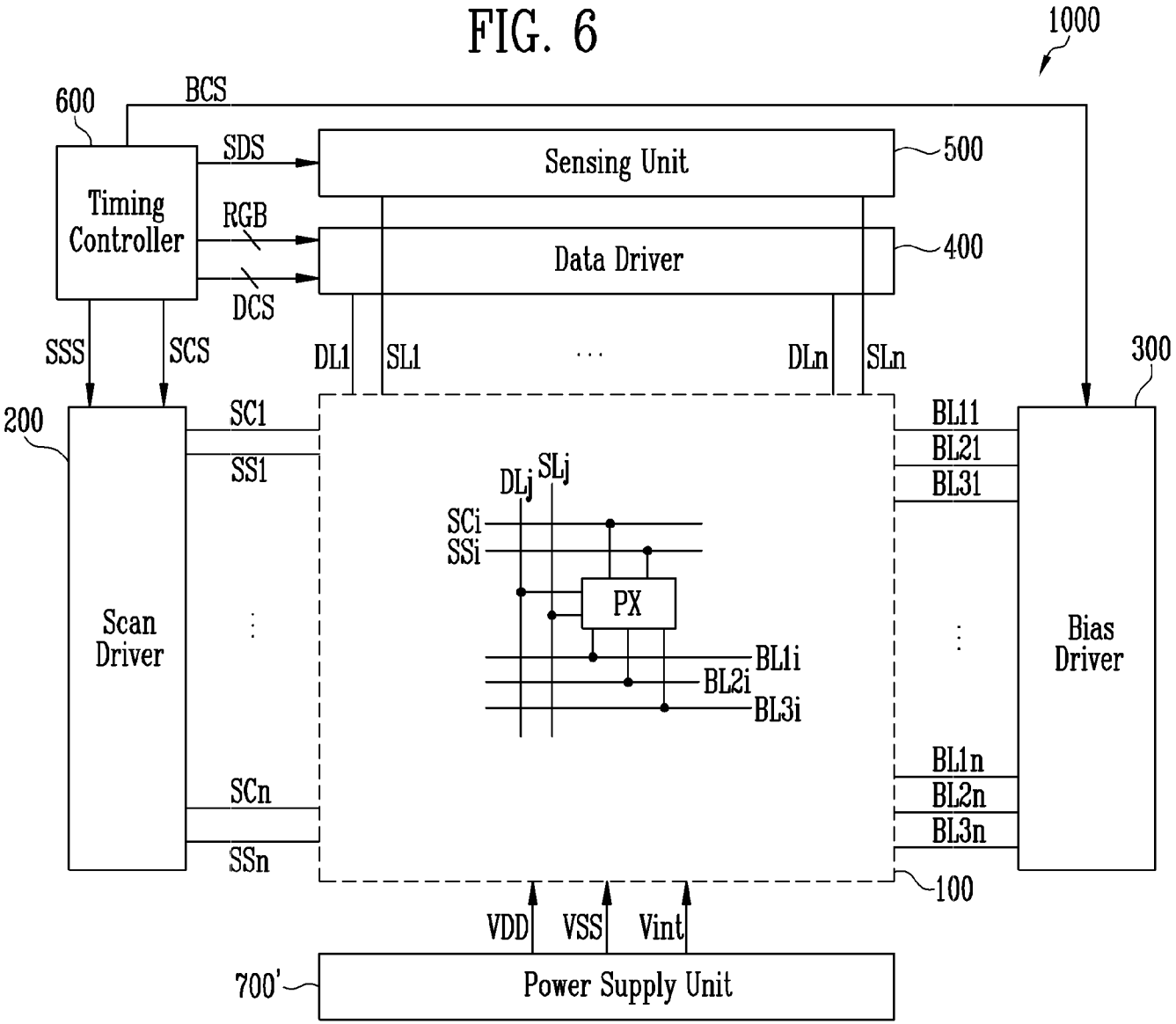
FIG. 6 is a schematic block diagram illustrating a display device according to some embodiments.
Figure 7:
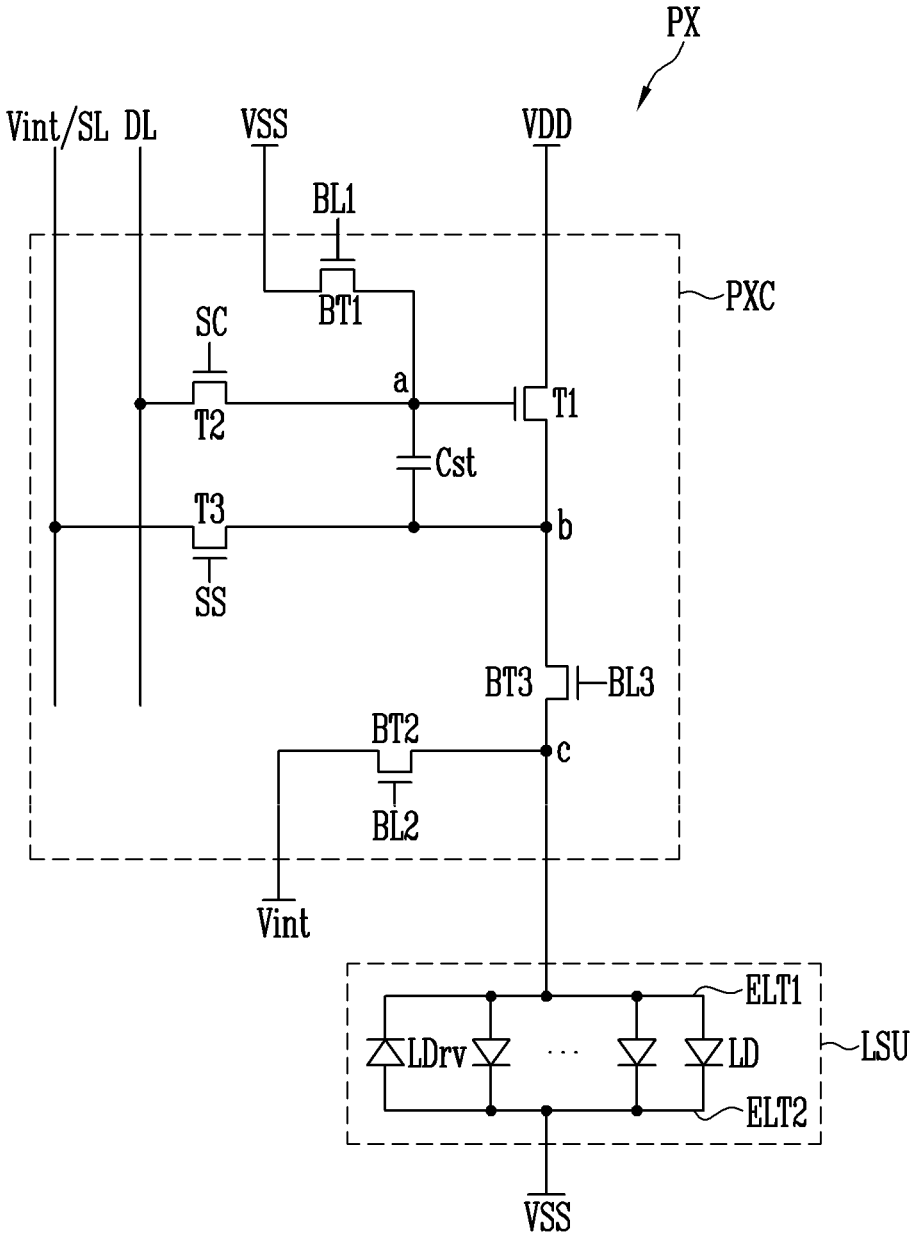
FIG. 7 is a circuit diagram illustrating one pixel of the display device according to some embodiments.
Figure 8:
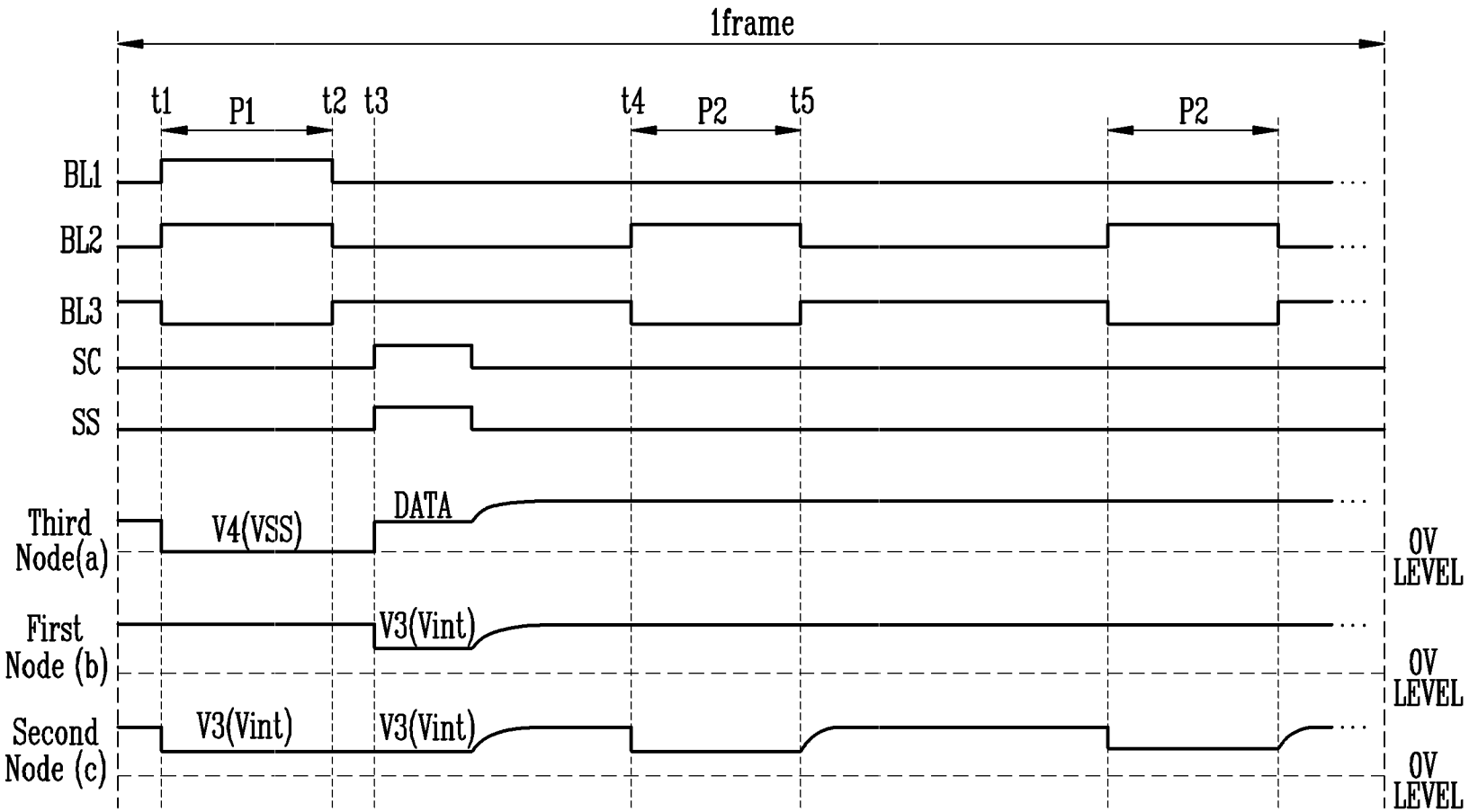
FIG. 8 is a timing diagram illustrating an example of an operation of one pixel shown in FIG. 7.

FIG. 6 is a schematic block diagram illustrating a display device according to some embodiments, FIG. 7 is a circuit diagram illustrating one pixel of the display device according to some embodiments, and FIG. 8 is a timing diagram illustrating an example of an operation of one pixel shown in FIG. 7.

The block diagram of FIG. 6 is similar to the block diagram of FIG. 1, the circuit diagram of FIG. 7 is similar to the circuit diagram of FIG. 2, and the timing diagram of FIG. 8 is similar to the timing diagram of FIG. 3. Hereinafter, descriptions overlapping with those of FIGS. 1 to 3 will be omitted, and differences will be mainly described.

First, referring to FIG. 6, a display device 1000 according to some embodiments may include a display unit 100, a scan driver 200, a bias driver 300, a data driver 400, a sensing unit 500, a timing controller 600, and a power supply unit 700'.

The display unit 100 may include a plurality of pixels PX and display an image. The display unit 100 may include a plurality of data lines DL1, . . . , and DLn, a plurality of sensing lines SL1, . . . , and SLn, a plurality of scan lines SC1, . . . , and SCn, a plurality of sensing control lines SS1, . . . , and SSn, a plurality of bias control lines BL11, . . . , BL1*n*, BL21, . . . , BL2*n*, BL31, . . . , and BL3*n*, and a plurality of pixels PX positioned to be respectively connected to the plurality of data lines DL1, . . . , and DLn and the plurality of scan lines SC1, . . . , and SCn. Each pixel PX may receive voltages of a first power source VDD, a second power source VSS, an initialization power source Vint, a first bias power source BV1, and a second bias power source BV2 from the power supply unit 700'.

The power supply unit 700' may supply the voltages of the first power source VDD, the second power source VSS, and the initialization power source Vint to the pixel PX.

Referring to FIG. 7, one pixel PX may include a pixel circuit PXC and a light source unit LSU for generating light having a luminance corresponding to a data signal.

The pixel circuit PXC may include a first transistor T1, a second transistor T2, a third transistor T3, a storage capacitor Cst, and bias transistors BT1, BT2, and BT3. The bias transistors BT1, BT2, and BT3 may include a first bias transistor BT1, a second bias transistor BT2, and a third bias transistor BT3.

The first bias transistor BT1 may be connected between the second power source VSS and a third node a. For example, a first electrode of the first bias transistor BT1 may be connected to the second power source VSS, a second electrode of the first bias transistor BT1 may be connected to the third node a, and a gate electrode of the first bias transistor BT1 may be connected to a first bias control line BL1. When the first bias transistor BT1 is turned on, a voltage of the second power source VSS may be applied to the third node a.

The second bias transistor BT2 may be connected between the initialization power source Vint and a second node c. For example, a first electrode of the second bias transistor BT2 may be connected to the initialization power source Vint, a second electrode of the second bias transistor BT2 may be connected to the second node c, and a gate electrode of the second bias transistor BT2 may be connected to a second bias control line BL2. When the second bias transistor BT2 is turned on, a voltage of the initialization power source Vint may be applied to the second node c. In some embodiments, the voltage of the second power source VSS may be set to a voltage level that is lower than the voltage of the initialization power source Vint.

A method of driving the pixel PX of FIG. 7 will be described with reference to FIG. 8. A first bias control signal and a second bias control signal may be respectively supplied to the first bias control line BL1 and the second bias control line BL2 between a first time point t1 and a second time point t2, so that the first bias transistor BT1 and the second bias transistor BT2 may be turned on. On the other hand, because the third bias transistor BT3 is not supplied with a separate bias control signal, the third bias transistor BT3 may be turned off.

In a first period P1, as the first bias transistor BT1 is turned on, a voltage of the second power source VSS may be applied to the third node a. That is, a voltage level V4 of the second power source VSS may be applied to the gate electrode of the first transistor T1. Further, in the first period P1, as the second bias transistor BT2 is turned on, an initialization voltage level V3 may be applied to the second node c. In addition, the initialization voltage level V3 may be set to a level that is higher than the voltage level V4 of the second power source VSS. Because the first transistor T1 may be turned on during the first period P1, a high level voltage may be supplied to the first node b by applying a current according to the first power source VDD.

At a third time point t3, a scan signal and a sensing control signal may be supplied to a scan line SC and a sensing control line SS, respectively, so that the second transistor T2 and the third transistor T3 may be turned on. As the second transistor T2 is turned on, a data voltage DATA may be applied to the third node a, and as the third transistor T3 is turned on, the initialization voltage level V3 may be applied to the first node b. In some embodiments, because the initialization voltage level V3 is set to a level that is lower than a voltage of the first power source VDD, a voltage level of the first node b may be lowered at the third time point t3.

After the third time point t3, a voltage corresponding to the difference between the data voltage DATA and the initialization voltage level V3 may be stored in the storage capacitor Cst. Here, because the initialization voltage level V3 is fixed to a constant voltage, the voltage stored in the storage capacitor Cst may be determined by the data voltage DATA.

After the voltage corresponding to the difference between the data voltage DATA and the initialization voltage level V3 is stored in the storage capacitor Cst, the first transistor T1 may supply a current corresponding to the voltage stored in the storage capacitor Cst to the light source unit LSU through the first node b, the third bias transistor BT3, and the second node c. Then, the light source unit LSU may generate light (e.g., light having a predetermined luminance) in response to the amount of current supplied from the first transistor T1.

Between a fourth time point t4 and a fifth time point t5, a second bias control signal may be supplied to the second bias control line BL2, and the supply of a third bias control signal to a third bias control line BL3 may be stopped.

When the second bias control signal is supplied to the second bias control line BL2, the second bias transistor BT2 may be turned on. When the supply of the third bias control signal to the third bias control line BL3 is stopped, the third bias transistor BT3 may be turned off. Accordingly, the first node b and the second node c may be electrically separated.

When the second bias transistor BT2 is turned on, a second bias voltage level V2 may be applied to the second node c. When the second bias voltage level V2 is applied to the second node c, the light emitting elements LD included in the light source unit LSU may be initialized to the applied bias state. In this case, the light emitting elements LD may be in a non-emission state.

After the fifth time point t5, as the third bias transistor BT3 is turned on again, the second node c may be connected to the first node b, and a voltage of the second node c may be transferred to the first node b. In this case, the light source unit LSU may generate light (e.g., light having a predetermined luminance) in response to the amount of current supplied from the first transistor T1.

Meanwhile, although a second period P2 is included once during one frame in FIG. 8, the present disclosure is not limited thereto. For example, the second period P2 for supplying the second bias voltage level V2 to the light source unit LSU may be included more than once in one frame.

In the second period P2, because the third bias transistor T3 is turned off, a bias voltage for supplementing the characteristics of the light source unit LSU may be provided regardless of the driving of the first transistor T1 and the data voltage DATA stored in the storage capacitor Cst.

Because the third bias transistor T3 connected to the second node c is turned off during the second period P2, the light emitting element LD of the light source unit LSU might not be supplied with a driving current and might not emit light. That is, the second period P2 may be referred to as a non-emission period.

Accordingly, the display device according to some embodiments may apply the bias voltage to the driving transistor and/or the light emitting element during one frame. Therefore, when an afterimage occurs due to changes in characteristics of the driving transistor and/or the light emitting element, the recovery time of the afterimage may be reduced.

According to the embodiments, by applying the bias voltage to the driving transistor and/or the light emitting element in the first period and the second period of one frame, the afterimage that may occur due to the changes in characteristics of the driving transistor and/or the light emitting element may be improved.

Effects of the present disclosure are not limited to the above-described effects, and more various effects are included within the present specification.

As described above, the optimal and/or suitable embodiments of the disclosure have been disclosed through the detailed description and the drawings. However, those skilled in the art or those of ordinary skill in the art will appreciate that various modifications and changes are possible without departing from the spirit and scope of the disclosure as set forth in the claims below.

Therefore, the technical scope of the disclosure is not limited to the detailed description described in the specification, but should be determined by the claims, with functional equivalents thereof to be included therein.

What is claimed is:

1. A pixel comprising:
a light source unit;
a first transistor coupled between a first power source and a first node, and configured to control a driving current applied to the light source unit;
a first bias transistor coupled between a first bias power source and a gate electrode of the first transistor; and
a second bias transistor coupled between a second bias power source and a second node that is electrically coupled to an anode of the light source unit such that the second bias transistor is directly coupled to the anode,
wherein the first bias transistor and the second bias transistor are configured to be turned on during a first period before a data voltage is applied among one frame, and
wherein the second bias transistor is configured to be turned on at least once during a second period after the data voltage is applied among the one frame.

2. The pixel of claim 1, wherein a voltage of the first bias power source has a level that is lower than that of the second bias power source.

3. The pixel of claim 1, further comprising a third bias transistor coupled between the first node and the second node.

4. The pixel of claim 3, wherein the third bias transistor is configured to be turned off in the second period among the one frame.

5. The pixel of claim 1, further comprising:
a second transistor coupled between the gate electrode of the first transistor and a data line for applying the data voltage; and
a third transistor coupled between the first node and a sensing line for receiving a voltage of an initialization power source.

6. The pixel of claim 5, wherein the second transistor and the third transistor are configured to be substantially simultaneously turned on between the first period and the second period.

7. The pixel of claim 6, further comprising a storage capacitor coupled between the first node and the gate electrode of the first transistor, and configured to store the data voltage.

8. The pixel of claim 5, wherein the light source unit comprises at least one light emitting element configured to emit light by the driving current.

9. The pixel of claim 8, wherein the first transistor is configured to receive the driving current from the first power source, and
wherein the light source unit is configured to supply the driving current supplied from the first transistor to a second power source that is set to a voltage value that is lower than that of the first power source.

10. The pixel of claim 9, wherein the first bias power source is the second power source, and wherein the second bias power source is the initialization power source.

11. A display device comprising:
pixels comprising:
a light source unit;
a first transistor coupled between a first power source and a first node for controlling a driving current applied to the light source unit;
a first bias transistor coupled between a first bias power source and a gate electrode of the first transistor; and a second bias transistor coupled between a second bias power source and a second node that is electrically coupled to an anode of the light source unit such that the second bias transistor is directly coupled to the anode; and a power source driver for providing the first bias power source and the second bias power source to the pixels, wherein the first bias transistor and the second bias transistor are configured to be turned on during a first period before a data voltage is applied among one frame, and wherein the second bias transistor is configured to be turned on at least once during a second period after the data voltage is applied among the one frame.

12. The display device of claim 11, wherein a voltage of the first bias power source has a level that is lower than that of the second bias power source.

13. The display device of claim 11, wherein the pixels further comprise a third bias transistor coupled between the first node and the second node, and configured to be turned off in the second period among the one frame.

14. The display device of claim 11, wherein the pixels further comprises:

a second transistor coupled between the gate electrode of the first transistor and a data line for applying the data voltage; and a third transistor coupled between the first node and a sensing line for receiving a voltage of an initialization power source.

15. The display device of claim 14, wherein the second transistor and the third transistor are configured to be substantially simultaneously turned on between the first period and the second period.

16. The display device of claim 15, wherein the first transistor is configured to receive the driving current from the first power source, and wherein the light source unit is configured to supply the driving current supplied from the first transistor as a second power source that is set to a voltage value that is lower than that of the first power source.

17. The display device of claim 16, wherein the first bias power source is the second power source, and wherein the second bias power source is the initialization power source.

18. A method of driving a display device comprising:

supplying a first bias voltage to a gate electrode of a first transistor, and supplying a second bias voltage to an anode of a light source unit, during a first period of one frame;

supplying a data voltage to a storage capacitor coupled to the gate electrode of the first transistor after the first period; and supplying the second bias voltage to the anode of the light source unit during a second period among the one frame after the data voltage is supplied, wherein the first bias voltage is distinct from the second bias voltage, and wherein the first bias voltage is not applied to the gate electrode of the first transistor during the second period.

19. The method of claim 18, wherein the first bias voltage has a level that is lower than the second bias voltage.

20. The method of claim 18, wherein the second period occurs multiple times during the one frame.

* * * * *